US007338125B2

(12) United States Patent
Grabowski

(10) Patent No.: US 7,338,125 B2
(45) Date of Patent: Mar. 4, 2008

(54) REHABILITATIVE AND RECREATIONAL ARMCHAIR

(76) Inventor: Stanislaw Grabowski, ul. Artyleryjska 6, 09-200 Sierpc (PL)

( * ) Notice: Subject to any disclaimer, the term of this patent is extended or adjusted under 35 U.S.C. 154(b) by 0 days.

(21) Appl. No.: 11/328,511

(22) Filed: Jan. 9, 2006

(65) Prior Publication Data

US 2006/0170264 A1 Aug. 3, 2006

(30) Foreign Application Priority Data

Jul. 21, 2004 (WO) ..... PCT/PL2004/000058

(51) Int. Cl.
*A47C 1/024* (2006.01)

(52) U.S. Cl. ..... 297/313; 297/314; 297/338

(58) Field of Classification Search ..... 297/313, 297/314, 325, 338, 339; 482/130, 137, 142
See application file for complete search history.

(56) References Cited

U.S. PATENT DOCUMENTS 342,020 A * 5/1886 Kitchen ..... 482/128
421,045 A * 2/1890 Caldwell ..... 297/302.4
929,272 A * 7/1909 Baron ..... 297/314
1,827,928 A * 10/1931 Berger ..... 297/291
2,554,490 A * 5/1951 Eames ..... 297/301.1
3,596,991 A * 8/1971 Mckee et al. ..... 297/286
4,632,455 A * 12/1986 Schiller et al. ..... 297/326
5,904,398 A * 5/1999 Farricielli ..... 297/313
5,967,610 A * 10/1999 Lin ..... 297/340

* cited by examiner

*Primary Examiner*—Peter R. Brown
(74) *Attorney, Agent, or Firm*—Thomas A. O'Rourke; Bodner & O'Rourke

(57) ABSTRACT

The rehabilitative and recreational armchair constructed of a framework made of tubes, bars and/or other elements, such as flat bars and angle bars, wherein the arms, the backrest and the seat are mounted. The seat is mounted only to the top of the spring whose lower end is fixed to the framework, while the mounting of the backrest to the framework allows for swinging motions. According to special mode of invention at least one head, preferably two heads, made of two extreme vertical connecting elements, connected to each other with two rollers all of these making up a framework. The framework is connected in a swinging manner to the main framework of the backrest, with the connecting rollers, serving as the upper and the lower side of the said framework, being equipped with swivel massage rolls which have an even surface and/or a rack-like shaped one.

2 Claims, 5 Drawing Sheets

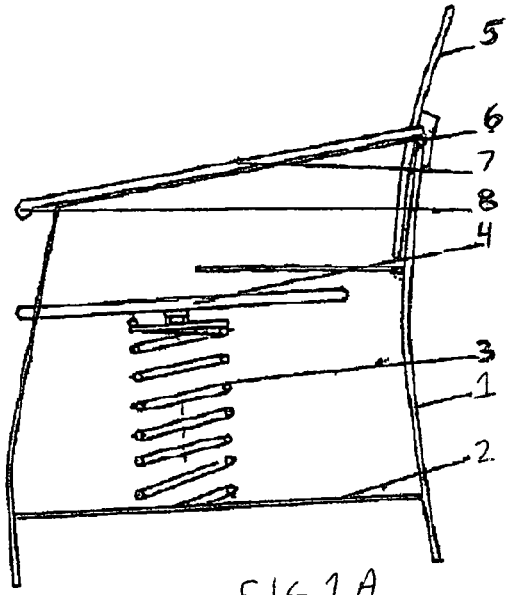
FIG 1A
FIG. 1B
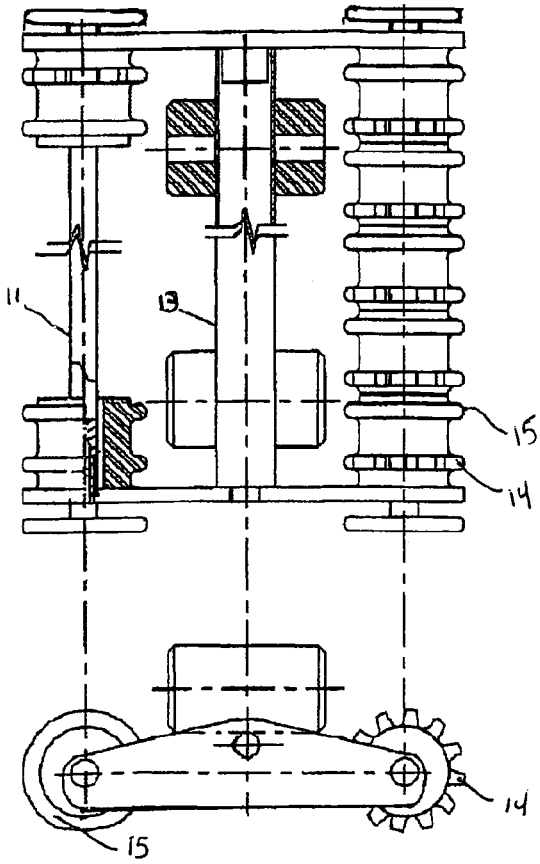

REHABILITATIVE AND RECREATIONAL ARMCHAIR

THE FIELD OF INVENTION

The present invention relates to a rehabilitative and recreational armchair, in particular for taking recreational position, as well as for active rehabilitative and motion exercises.

BACKGROUND OF INVENTION

The known armchairs of various constructions usually consist of a framework structure on which its major elements are mounted, such as the seat, the arms and the backrest. These elements have various shapes. They could be covered with upholstery, with some decorative elements added, etc.

There are armchairs which have a simple structure of bars, tubes, etc. which serve as a framework on which the above mentioned elements, i.e. the seat and the backrest, are mounted.

The known armchairs, as described above, allow for recreation or for the use while the user remains in a static position, therefore they do not allow for active use while the user is in motion, which is so important for his health, and very often for rehabilitation after past diseases, as well as for loosing overweight.

The rehabilitative armchair according to the present invention consists of a framework in the form of structure made of tubes, bars and/or other elements, such as flat bars and angle bars, on which the arms, the backrest and the seat are mounted.

Its distinctive feature is the seat which is mounted only to the top of the spring whose lower end is fixed to the framework, while the mounting of the backrest to the framework allows for swinging motions.

SUMMARY OF THE INVENTION

According to the advantageous form of the invention, the arms have handles. These handles can be formed at the end of the arm or installed there permanently or temporarily. According to special advantageous form of invention described armchair, though it does meet the requirements and the principles of rehabilitation, it does not do so entirely. In particular, it does not allow for relaxation and rehabilitation exercises in combination with spine massage, which are especially recommended in spine conditions. With this invention, the solution is equipping the armchair with a specially designed backrest, which has at least one head (preferably two heads) made of two extreme vertical connecting elements, connected to each other with two rollers, all of these making up a framework which is articulately connected in a swinging manner to the main framework of the backrest, with the connecting rollers, serving as the upper and the lower side of the said framework, being equipped with swivel rolls which have an even surface and/or a rack-like shaped one.

BRIEF DESCRIPTION OF THE INVENTION

The armchair constructed according to the invention, as an example which, however, does not delimit the essence of the invention, was presented on the illustrations, where;

FIGS. 1A and B presents the armchair from the side perspective with its structural elements marked.

Figure 2:
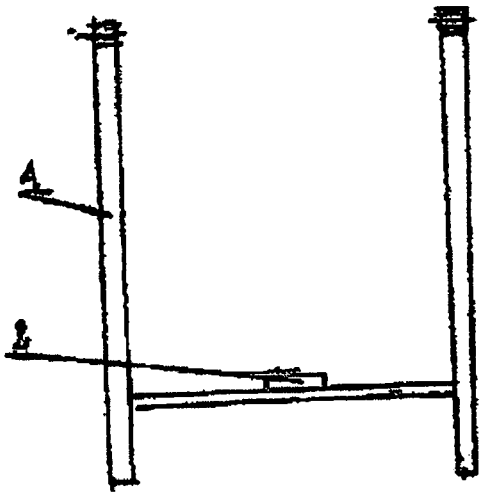

FIG. 2 presents the armchair's framework from the front.

Figure 3:
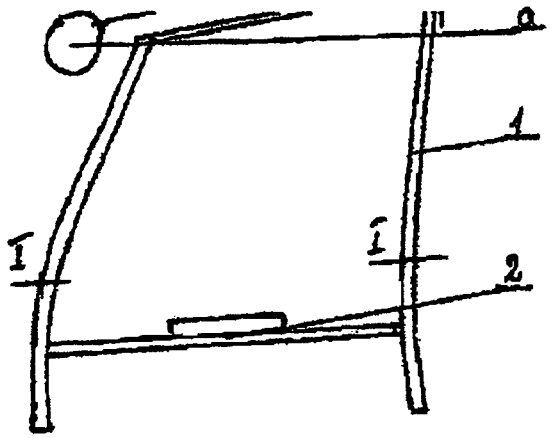

FIG. 3 presents the armchair's framework from the side perspective.

Figure 4:
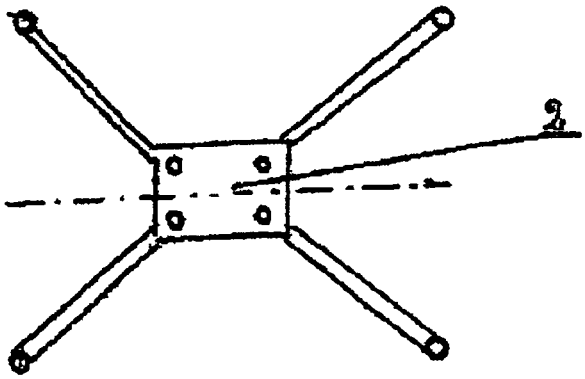

FIG. 4 presents the top view of the element which serves as a support for the spring.

Figure 5:
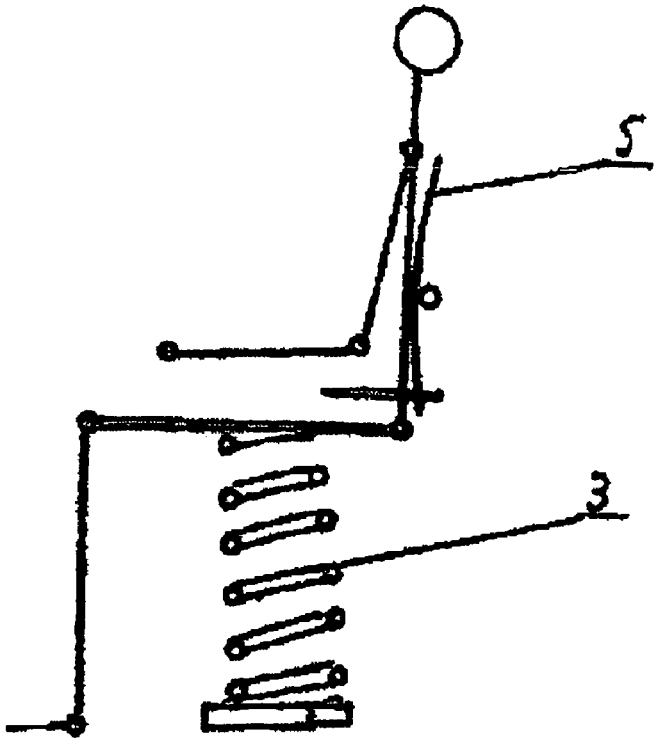
Figure 6:
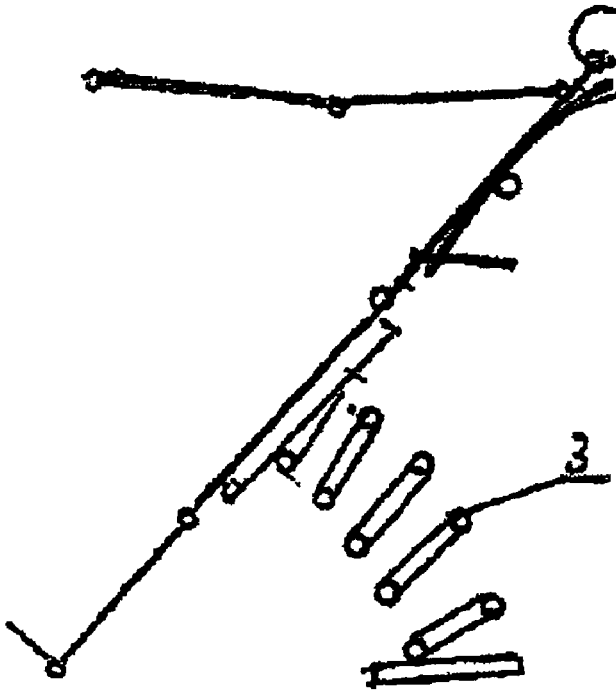
Figure 7:
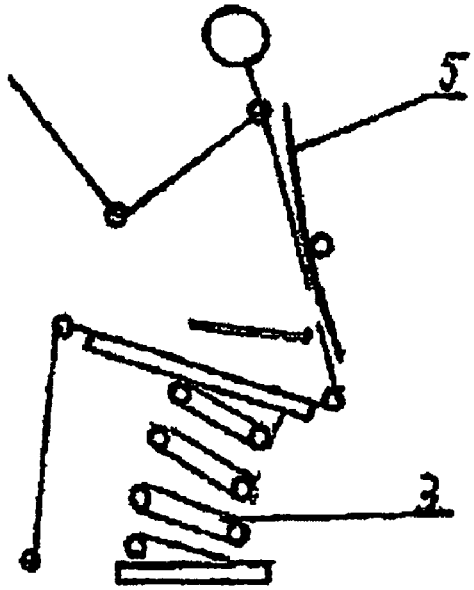

FIGS. 5-7 present the schematic rehabilitative activities with a man's silhouette shown.

Figure 8:
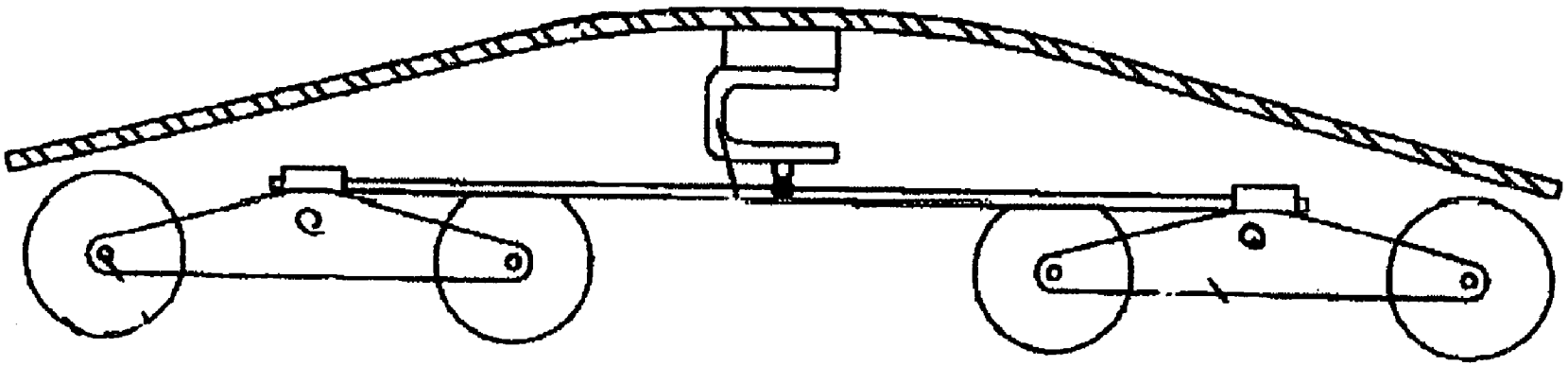
Figure 9:
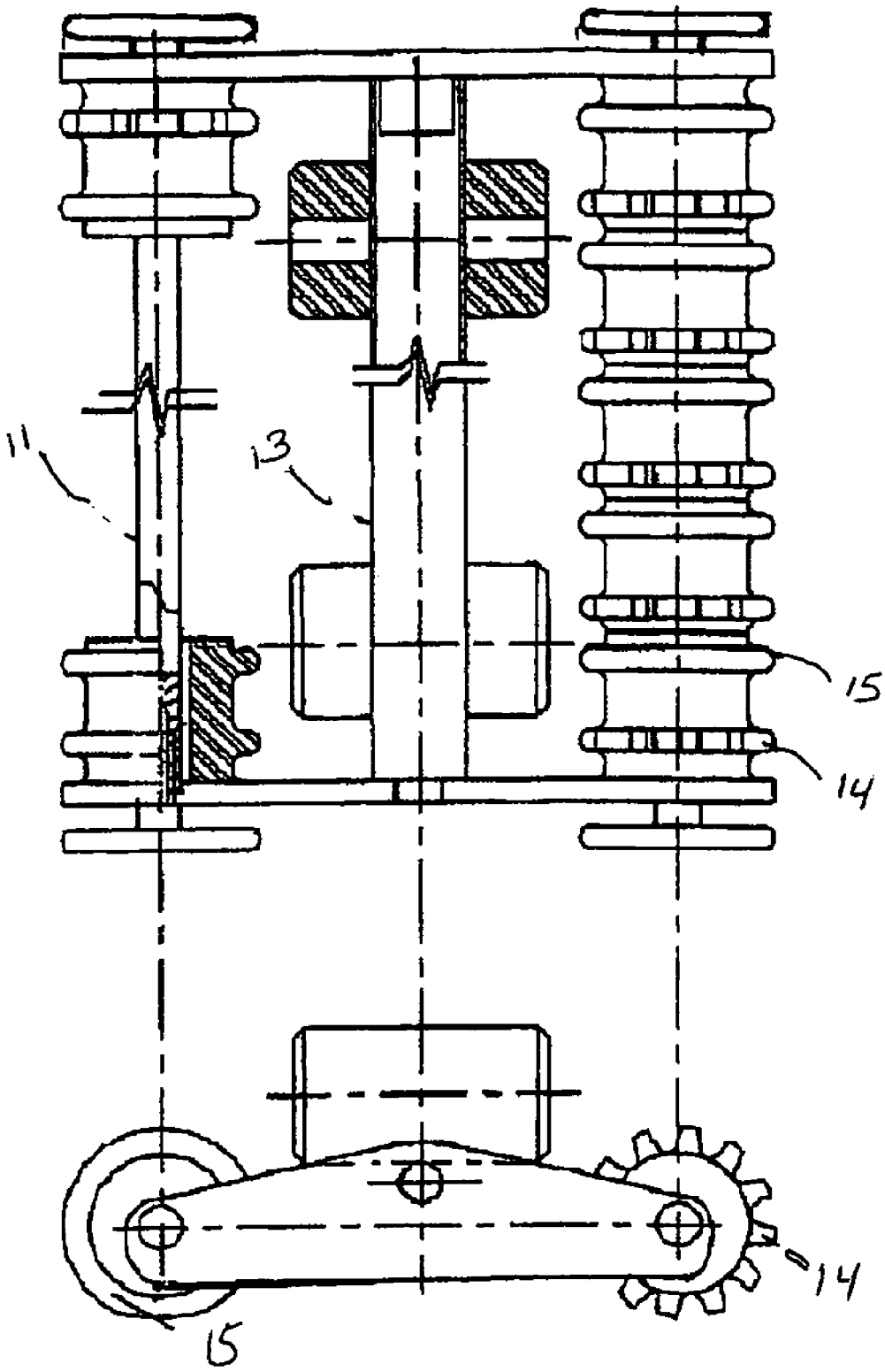

FIGS. 8 and 9 present the improved backrest of the armchair with the rollers for spine massage.

DETAILED DESCRIPTION OF INVENTION

As shown on FIG. 1, the armchair constructed according to the invention is made of a framework which serves as a bar and/or tube structure 1. In the lower part of the framework there is a bearing element 2, on which the bearing spring is based, and to which it is connected, carrying the seat 4 at the back of the armchair, mounted on the top of the spring. The backrest 5 is connected to the framework 1 through a pivot 6 sunk into the holes in the framework or is attached on hinges. On the arms 7, there are ergonomic handles 8 attached to or formed on the latter. As mentioned earlier, the improved version of the armchair has a specially designed backrest with at least one head (preferably two heads) made of two extreme vertical connecting elements, connected with two rollers 10 which, together with the earlier mentioned rollers, form a framework, which through a pivot is articulately connected in a swinging manner to the main framework of the backseat, with the said connecting rollers—which form the upper and the lower side of the said framework—equipped with swivel rolls with an even surface 14 and/or with a rack-like shaped surface 14. It is obvious that the above described backrest can be removable (owing to the said pivot) and that on its other side (opposite to the rolls) it can have an even surface. In the latter case, the backrest may be turned around to resign, for example, from massaging the spine.

The user assumes a normal seating position, as shown on FIG. 5, and holds the handles 8 with his/her hands. Then, by stretching the legs and the arms, while holding the handles, he/she has an effect on the bearing spring 3 and on the backrest 5. The bearing spring deforms and the backrest changes its angle. Then, by bending the arms at the elbows while still holding the handles 8, a rowing-like effect is obtained and—with the improved backrest with rollers—the spine gets massaged as well.

By repeating the above mentioned activities, it is possible to exercise—in stationary environment-limbs, stomach muscles, chest muscles and—indirectly—work-place where the work is performed in a sitting position or during watching TV. The investigations performed proved that regular exercises in the armchair as invented are effective in the management of overweight, anoxia or spine defects.

The invention claimed is:

1. A rehabilitative and recreational arm chair comprising:

a frame having a first and second arm, said first and second arms each have permanent handles;

a backrest; and a seat, said seat being mounted on a base portion of said frame solely by means of a spring between said seat and said frame, said spring having a first end mounted to the underside of said seat and a second end mounted to said base portion of said frame, said backrest being mounted to said frame so that said backrest may fold forward and backwards about an axis while a user is sitting on said seat and wherein when a user stretches said user's arms and legs while holding said handles said spring deforms and said back rest changes angles to a first position and when said user bends said user's arms and legs while still holding said handles said spring is again deformed and said backrest changes angle to a second position such that a rowing like effect is achieved by said user.

2. The arm chair according to claim 1 wherein said backrest has rollers that's massage said user's spine while said backrest changes angles.

* * * * *